US009538286B2

(12) United States Patent
Samuelsson

(10) Patent No.: US 9,538,286 B2
(45) Date of Patent: Jan. 3, 2017

(54) SPATIAL ADAPTATION IN MULTI-MICROPHONE SOUND CAPTURE

(75) Inventor: Leif Jonas Samuelsson, Sundbyberg (SE)

(73) Assignee: Dolby International AB, Amsterdam Zuidoost (NL)

( * ) Notice: Subject to any disclaimer, the term of this patent is extended or adjusted under 35 U.S.C. 154(b) by 325 days.

(21) Appl. No.: 13/984,137

(22) PCT Filed: Feb. 10, 2012

(86) PCT No.: PCT/EP2012/052322

§ 371 (c)(1),
(2), (4) Date: Aug. 7, 2013

(87) PCT Pub. No.: WO2012/107561

PCT Pub. Date: Aug. 16, 2012

(65) Prior Publication Data

US 2013/0315403 A1 Nov. 28, 2013

Related U.S. Application Data

(60) Provisional application No. 61/441,633, filed on Feb. 10, 2011.

(51) Int. Cl.
*H04R 3/00* (2006.01)
*H04R 29/00* (2006.01)
(Continued)

(52) U.S. Cl.
CPC ..... *H04R 3/005* (2013.01); *H04R 29/006* (2013.01); *H04R 2430/20* (2013.01)

(58) Field of Classification Search
USPC .... 381/94.1, 92; 704/E11.003, E21.004, 233
See application file for complete search history.

(56) References Cited

U.S. PATENT DOCUMENTS 8,452,019 B1 * 5/2013 Fomin ..... H04R 29/005 381/58
2002/0048377 A1 * 4/2002 Vaudrey ..... H04R 3/005 381/94.7

(Continued)

FOREIGN PATENT DOCUMENTS

WO 2007/025123 3/2007
WO 2008/079327 7/2008

(Continued)

OTHER PUBLICATIONS

Martin, R., "Spectral Subtraction Based on Minimum Statistics," Proc. 7th European Signal Processing Conf., EUSIPCO-94, pp. 1182-1185, Sep. 1994.

(Continued)

*Primary Examiner* — Duc Nguyen
*Assistant Examiner* — Yogeshkumar Patel
(74) *Attorney, Agent, or Firm* — Charles L. Hamilton; Fountainhead Law Group, P.C.

(57) ABSTRACT

A spatial adaptation system for multiple-microphone sound capture systems and methods thereof are described. A spatial adaptation system includes an inference and weight module configured to receive a inputs. The inputs based on two or more input signals captured by at least two microphones. The inference and weight module to determine one or more weight values base on at least one of the inputs. The spatial adaptation system also including a noise magnitude ratio update module coupled with the inference and weight module. The noise magnitude ratio update module to determine an updated noise target based on the one or more weight values from the inference and weight module.

21 Claims, 5 Drawing Sheets

(51) Int. Cl.
*G10L 21/028* (2013.01)
*G10L 25/78* (2013.01)
*G10L 21/0216* (2013.01)

(56) References Cited

U.S. PATENT DOCUMENTS

2003/0101055 A1* 5/2003 Son ..... G10L 21/02 704/240
2005/0249359 A1* 11/2005 Roeck ..... H04R 3/005 381/92
2007/0047742 A1* 3/2007 Taenzer ..... H04R 3/005 381/92
2008/0048988 A1* 2/2008 Qi ..... G06F 3/03545 345/173
2008/0159560 A1* 7/2008 Song ..... G10L 25/78 381/94.1
2008/0219471 A1* 9/2008 Sugiyama ..... G10L 21/0208 381/94.2
2008/0219473 A1* 9/2008 Sugiyama ..... G10L 21/0208 381/94.4
2008/0219483 A1* 9/2008 Klein ..... H04R 3/005 381/174
2009/0060224 A1* 3/2009 Hayakawa ..... H04R 3/005 381/97
2009/0136057 A1* 5/2009 Taenzer ..... H04R 3/005 381/74
2009/0175466 A1* 7/2009 Elko ..... H04R 3/005 381/94.2
2009/0190769 A1* 7/2009 Wang ..... H03G 3/32 381/66
2009/0196429 A1* 8/2009 Ramakrishnan ..... H04R 3/005 381/26
2009/0238377 A1* 9/2009 Ramakrishnan ..... G10L 21/028 381/92
2010/0111329 A1* 5/2010 Namba ..... H04R 3/005 381/119
2010/0189280 A1* 7/2010 Shimada ..... G10L 21/0208 381/94.1
2010/0198990 A1* 8/2010 Shimada ..... G10L 19/008 709/246
2010/0211382 A1* 8/2010 Sugiyama ..... H04B 3/23 704/205
2010/0283536 A1* 11/2010 Nomura ..... G10L 19/00 327/551
2011/0026730 A1* 2/2011 Li ..... H04R 3/005 381/92
2011/0085686 A1* 4/2011 Bhandari ..... H04R 3/005 381/313
2011/0096915 A1* 4/2011 Nemer ..... H04M 3/568 379/158
2011/0096937 A1* 4/2011 Zhang ..... H04R 3/005 381/71.11
2011/0142256 A1* 6/2011 Lee ..... G10L 21/0208 381/94.3
2012/0163496 A1* 6/2012 Wang ..... H04L 25/03898 375/295
2012/0207325 A1* 8/2012 Taenzer ..... H04R 3/005 381/94.1

FOREIGN PATENT DOCUMENTS

WO 2009/026569 2/2009
WO 2009/130388 10/2009
WO 2012/109019 8/2012
WO 2012/109384 8/2012
WO 2012/109385 8/2012

OTHER PUBLICATIONS

Stahl, V. et al, "Quantile Based Noise Estimation for Spectral Subtraction and Wiener Filtering," Proc IEEE International Conference on Acoustics, Speech, and Signal Processing, vol. 3, published in 2000; pp. 1875-1878.
Martin, R., Noise Power Spectral Density Estimation Based on Optimal Smoothing and Minimum Statistics, IEEE Transactions on Speech and Audio Processing, vol. 9, Issue 5, Jul. 2001.
Cohen, I., "Noise Spectrum Estimation in Adverse Environments: Improved Minima Controlled Recursive Averaging," IEEE Transactions on Speech and Audio Processing, Sep. 2003.

* cited by examiner

SPATIAL ADAPTATION IN MULTI-MICROPHONE SOUND CAPTURE

TECHNICAL FIELD

The present disclosure relates generally to spatial adaptation. In particular, the present disclosure relates to spatial adaptation in multi-microphone systems.

BACKGROUND

In sound capture systems, the goal is to capture a target sound source such as a voice. But, the presence of other sounds around the target sound source can complicate this goal. One way to capture sound in the presence of noise sources, is to use multiple microphones or microphone arrays in a multi-microphone sound capture system. For example, headsets, handsets, car kits and similar devices utilize multiple microphones in array configurations to reduce or remove acoustic background noise. In such sound capture systems, the use of multiple microphones or microphone arrays provides the ability to capture the target sound source and eliminate the other sound sources or noise sources through the use of noise cancellation techniques.

To ensure that these multiple-microphone sound capture systems perform optimally, one desires that all the microphones in the system have similar performance characteristics. One way to achieve this is through microphone matching or noise target adaptation. One purpose of microphone matching is to ensure that the signal spectra of all microphones in the system are similar in the presence of the same stimuli or source.

Microphone matching can be done during manufacturing of multiple-microphone sound capture systems, although, these processes are complicated. Moreover, microphone matching during the manufacturing process adds a great deal of time and cost to the manufacture of multiple-microphone sound capture systems. In addition, microphone matching during the manufacturing process does not take into account changes in the multiple-microphone system after the manufacturing process is complete.

OVERVIEW

A spatial adaptation system for multiple-microphone sound capture systems and methods thereof are described. A spatial adaptation system includes an inference and weight module configured to receive inputs. The inputs are based on two or more input signals captured by at least two microphones. The inference and weight module is operative to determine one or more weight values base on at least one of the inputs. The spatial adaptation system also includes a noise magnitude ratio update module coupled with the inference and weight module. The noise magnitude ratio update module is operative to determine an updated noise target based on the one or more weight values from the inference and weight module.

Other features and advantages of embodiments of the disclosure will be apparent from the accompanying drawings and from the detailed description that follows.

BRIEF DESCRIPTION OF THE DRAWINGS

Embodiments of the disclosure herein are illustrated by way of example and not limitation in the figures of the accompanying drawings, in which like references indicate similar elements and in which.

DESCRIPTION OF EXAMPLE EMBODIMENTS

Example embodiments of a spatial adaptation system for multiple microphone sound capture systems are described herein. Those of ordinary skill in the art of spatial adaptation for multiple-microphone sound capture systems will realize that the following description is illustrative only and is not intended to be in any way limiting. Other embodiments will readily suggest themselves to such skilled persons having the benefit of this disclosure. Reference will now be made in detail to embodiments as illustrated in the accompanying drawings.

Embodiments of a spatial adaptation system and methods thereof for use with multiple-microphone capture systems are described that perform microphone matching in real-time during normal use of a sound capture system or device. Examples of a multiple-microphone sound capture system or device include, but are not limited to, headsets, handsets, car kits and similar devices that use multiple microphones or microphone arrays. Embodiments of a spatial adaptation system provide a way to lower manufacturing cost and complexities. Moreover, the ability to perform microphone matching in real-time takes into account any differences in microphone characteristics that occurred after the manufacturing system.

For an embodiment, the spatial adaptation system uses far-field noise as a stimuli or a source for the adaptation of a multiple-microphone system. A far-field noise, for example, includes a sound that is not in direct proximity to a microphone. The spatial adaptation system uses the far-field noise to determine how characteristics differ between microphones in the multiple-microphone system. Another embodiment of the spatial adaptation system determines the characteristics of the microphones in the absence of far-field noise.

Figure 1:
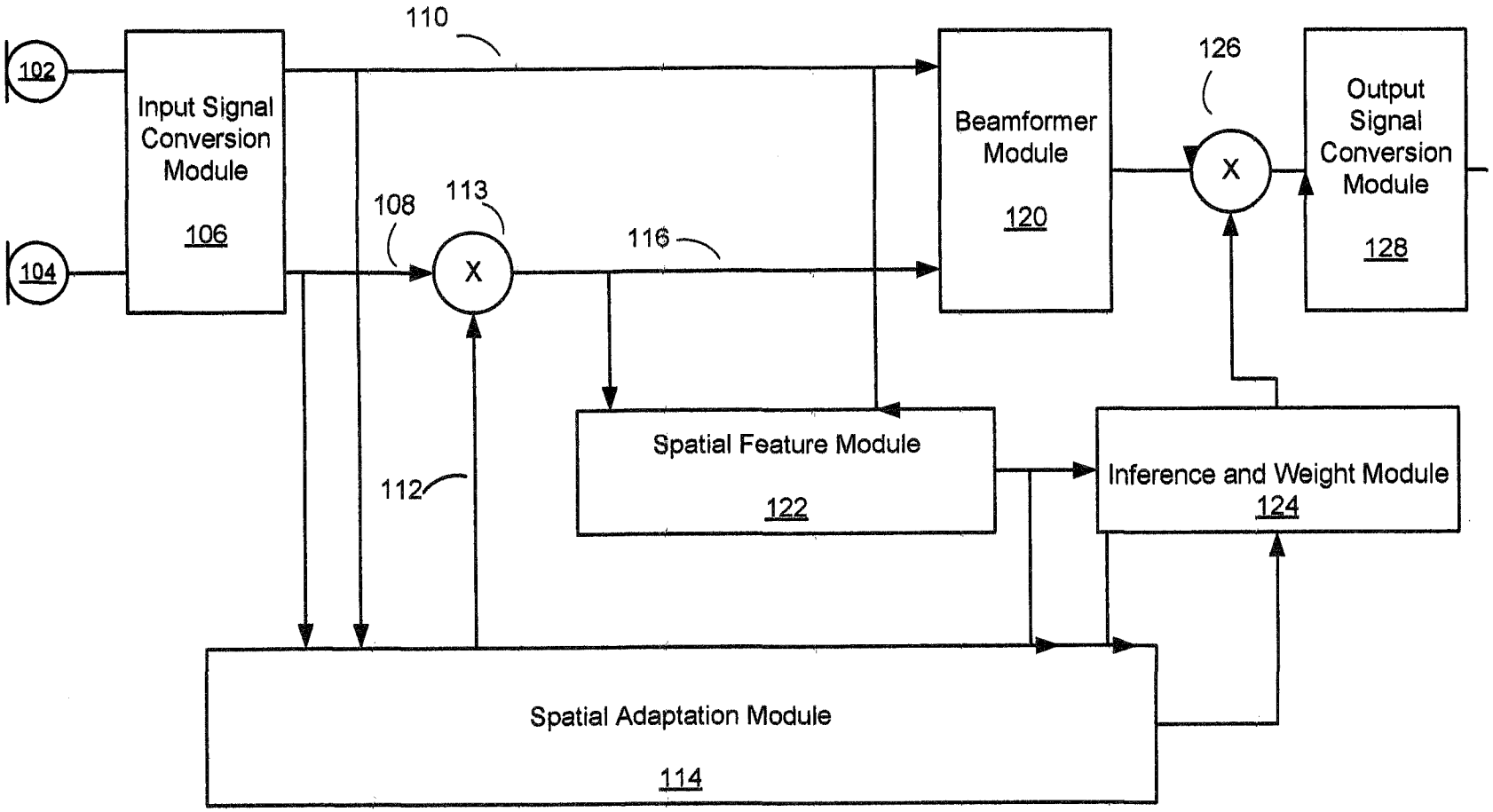
FIG. 1 illustrates a block diagram of a multiple-microphone sound capture system including an embodiment of the spatial adaptation system.

FIG. 1 illustrates an example of a multiple-microphone sound capture system including an embodiment of the spatial adaptation system. The FIG. 1 embodiment includes microphones 102 and 104. For some embodiments microphones 102 and 104 may be located at a predetermined distance from one another. For example, microphone 102 may be a front microphone located in close proximity to the sound source. Microphone 104 may be a rear microphone located at a fixed distance away from the front microphone 102. As such, this results in rear microphone 104 being further from the sound source than front microphone 102. Moreover, front microphone 102 may be implemented using more than one microphone such as an array of microphones, and similarly with rear microphone 104. For an embodiment that uses more than two microphones, the microphones may be located at predetermined distances from each other microphone. For some embodiments the sound source is any source desired to be captured including, but not limited to, speech.

Coupled with the microphones 102 and 104 is an input signal domain conversion module 106 that converts the output signals from the microphones 102 and 104. For an embodiment the input signal conversion module 106 converts time-domain signals, received as output from the microphones 102 and 104, into frequency-domain signals. The input signal conversion module 106, for some embodiments, performs time-frequency analysis separately on output from microphone 102 and output from microphone 104. The time-frequency analysis may be performed using any transform or filter bank that decomposes a signal into components that represent the input signal. Such transforms include continuous and discrete transforms. For example, time-frequency analysis may be performed using short-term Fourier transform (STFT), Hartley transform, Chirplet transform, fractional Fourier transform, Hankel transform, discrete-time Fourier transform, Z-transform, modified discrete cosine transform, discrete Hartely transform, Hadamard transform, or any other transform to decompose a signal into components to represent an input signal. A certain embodiment uses short-term Fourier transform to convert the output from microphones 102 and 104 into the frequency domain.

At signal conversion module 106, the transform is applied to the each output signal from microphones 102 and 104 for certain time intervals. For example, the time intervals may be on the order of milliseconds. For some embodiments, the time interval may be on the order of tens of milliseconds. For certain embodiments, the transforms are applied to the output signal of a microphone at intervals ranging from about 10 to 20 milliseconds. Moreover, the frequency resolution of the transform may change based upon the requirements of the system. For some embodiments, the frequency resolution may be on the order of a kilohertz. For another embodiment, the frequency resolution may be on the order of a few hundred hertz. For other embodiments the frequency resolution may be on the order of tens of hertz. For a particular embodiment the frequency resolution includes a range from about 50 to 100 hertz.

For embodiments, the frequency coefficients determined by the transform are used for subsequent processing. Grouping, or banding of frequency coefficients may be used to make subsequent processing more efficient and to improve stability of values determined by the spatial adaptation system, which leads to improved sound quality of the captured source. For an embodiment, frequency bins or transform coefficients are grouped into bands. According to an embodiment, 128 frequency bins are grouped into 32 bands. For some embodiments, the number of frequency bins in each band varies with the center frequency of the band. In other words, the number of frequency bins in each band is determined based on a given center frequency of that band. As such embodiments described below may operate on a signal and determine values for a frequency band or for one or more frequency bins. For some embodiments, different time-frequency analyses are used at different parts of the system.

As illustrated in the FIG. 1 embodiment, spatial adaptation module 114 is coupled with the output of the input signal conversion module 106. As such, the spatial adaptation module 114 uses the converted front microphone signal 110 and the converted rear microphone signal 108 to estimate the long term average of magnitude ratios for noise (discussed in more detail below), also called noise targets. This estimate of the long term average of magnitude ratios for noise is then used to modify the outputs from the input signal conversion module 106 so that the signals match. For some embodiments, the signals are considered matched when the power of the signals is similar to each other over a predetermined frequency range. For an embodiment, the signals are considered matched when the power in each individual, separate frequency band is similar. For the FIG. 1 embodiment, the spatial adaptation module 114 adjusts the converted rear microphone signal 108 using microphone matching multiplier 113. But, for other embodiments one or more of the converted microphone signals may be adjusted to achieve microphone matching.

For an embodiment, spatial adaptation module 114 uses the logarithmic power of the front and rear microphone at a predetermined frequency or predetermined frequency range. The spatial adaptation module 114 then determines a noise target such that when this value is added in the logarithmic domain (multiplied in the linear domain) to the power of the rear microphone the resulting power equals that of the logarithmic power in the front microphone. This noise target ("NT") is then applied to microphone matching multiplier 113 creating a matched signal 116.

As further illustrated in the FIG. 1 embodiment, beamformer module 120 is coupled with signal conversion module 106 such that beamformer module 120 receives as input the converted front microphone signal 110. Moreover beamformer module 120 is coupled with microphone matching multiplier 113. As such, beamformer module 120 also receives as input matched signal 116. For some embodiments beamformer module 120 is a fixed beamformer. As is known in the art, a fixed beamformer uses a fixed set of weights and time-delays to combine the signals to create a resultant signal or combined signal that minimizes the noise or unwanted aspects of a signal. For other embodiments beamformer module 120 is an adaptive beamformer. In contrast to a fixed beamformer, an adaptive beamformer dynamically adjusts weights and time-delays using techniques know in the art to combine the signals.

For the FIG. 1 embodiment, beamformer module 120 combines the converted front microphone signal 110 with the matched signal 116. Beamformer module 120, as illustrated in the FIG. 1 embodiment, is coupled with combined signal multiplier 126. Combined signal multiplier 126 is coupled with conversion module 128 and inference and weight module 124.

As illustrated in the FIG. 1 embodiment, the inference and weight module 124 is further coupled with the spatial feature module 122 and spatial adaptation module 114. According to an embodiment, the inference and weight module 124 determines one or more inferences that are used to determine whether to update the noise targets. Inference includes but is not limited to self noise detection, voice/noise classification, interferer level estimation/detection, and wind level estimation/detection.

Moreover, the inference and weight module 124 according to an embodiment also determines a gain to be applied to combined signal multiplier 126. For some embodiments the gain is derived from spatial features and temporal features. Temporal features that may be used to determine the gain include, but are not limited to, posterior SNR, the difference between a particular feature in the current frame and the same feature in the previous frame ("delta feature"). For some embodiments, a delta feature measures the change in a particular feature from one frame to the next and can be used to discriminate between a noise target and voice target. Spatial features used to determine the gain include, but are not limited to, magnitude ratios, phase differences, and coherence between the microphone signals received from front microphone 102 and rear microphone 104.

For an embodiment the inference and weight module 124 determines a gain according to $$g = \frac{1}{\left(1 + \left|MR - \overline{MR}_V^{out}\right|\right)^{\alpha}}$$

where $\overline{MR}_V^{out}$ is an average over time frames that are dominated by the desired source, discussed in more detail below. MR is the magnitude ratio between the converted front microphone signal 110 and the matched microphone signal 116, both of the current frame. $\overline{MR}_V^{out}$, which is determined offline based on matched microphone signals. Moreover, $\alpha$ is a positive value. According to another embodiment, the gain is determined according to $$g = \beta^{-\left|MR - \overline{MR}_V^{out}\right|^{\alpha}}$$

where $\beta$ and $\alpha$ are positive. For an embodiment, $\beta>1$. For yet another embodiment, $\beta \approx e \approx 2.71$. For other embodiments, $\beta$ is determined to optimize the gain for a frequency or frequency range because $\beta$ is frequency dependent. $\beta$ may also be determined empirically, according to an embodiment, by operating a multiple-microphone sound capture system over a variety of operating conditions.

In addition, $\alpha>0$ for an embodiment. For yet another embodiment, $\alpha=2$. For other embodiments, $\alpha$ is determined to optimize the gain for a frequency or frequency range because $\alpha$ is frequency dependent. $\alpha$ may also be determined empirically, according to an embodiment, by operating a multiple-microphone sound capture system over a variety of operating conditions.

For another embodiment, gain module may determine a composite gain by determining a gain for each feature according to $$g_{MR} = \frac{1}{\left(1 + \left|MR - \overline{MR}_V^{out}\right|\right)^{\alpha}}$$

and $$g_{PD} = \frac{1}{\left(1 + \left|PD - \overline{PD}_V^{out}\right|\right)^{\alpha}}$$

where $g_{MR}$ is a determined gain for the magnitude ratios and $g_{PD}$ is a determined gain for the phase differences. The composite gain g can be determined according to $$g = g_{MR} g_{PD}.$$

For an embodiment, inference and weight module 124 determines a gain for each time frame and for each frequency bin or band in that time frame. The gain, according to an embodiment, that is applied to the combined signal multiplier is a normalized or smoothed across a frequency range. For yet another embodiment, the gain is also normalized or smoothed across time frames.

Spatial features are determined by spatial feature module 122 according to an embodiment. For an embodiment, the spatial features are instantaneous and computed independently for each frame. Spatial feature module 122 is coupled with the signal conversion module 106 to receive the converted front microphone signal 110. Moreover, spatial feature module 122 is coupled with the spatial adaptation module 114.

According to an embodiment, spatial adaptation module 114 receives spatial features as determined by spatial feature module 122. For example, spatial adaptation module 114 receives magnitude ratios, phase differences, and coherence values from spatial feature module 122. Spatial adaptation module 114, according to an embodiment, determines the noise target based on the values received from the spatial feature module 122.

As discussed above, the inference and weight module 124 provides the gain value to combined signal multiplier 126 for an embodiment. As illustrated in the FIG. 1 embodiment, combined signal multiplier 126 is coupled with signal conversion module 128. Signal conversion module 128, according to an embodiment, performs an inverse transform on the output from the combined signal multiplier 126. For such an embodiment, this converts the output from the combined signal multiplier 126 from the frequency domain to the time domain. The transform used for the conversion would be the inverse of the transform used for signal conversion module 106, according to an embodiment. Examples of such transforms include, but are not limited to, the inverse transforms of short-term Fourier transform (STFT), Hartley transform, Chirplet transform, fractional Fourier transform, Hankel transform, discrete-time Fourier transform, Z-transform, modified discrete cosine transform, discrete Hartely transform, Hadamard transform, or any other transform to reconstruct a signal from components used to represent the original signal. For some embodiments, the output signal conversion module 128 uses an inverse short-term Fourier transform to convert the output from the combined signal multiplier 126 from the frequency domain to the time domain.

Figure 2:
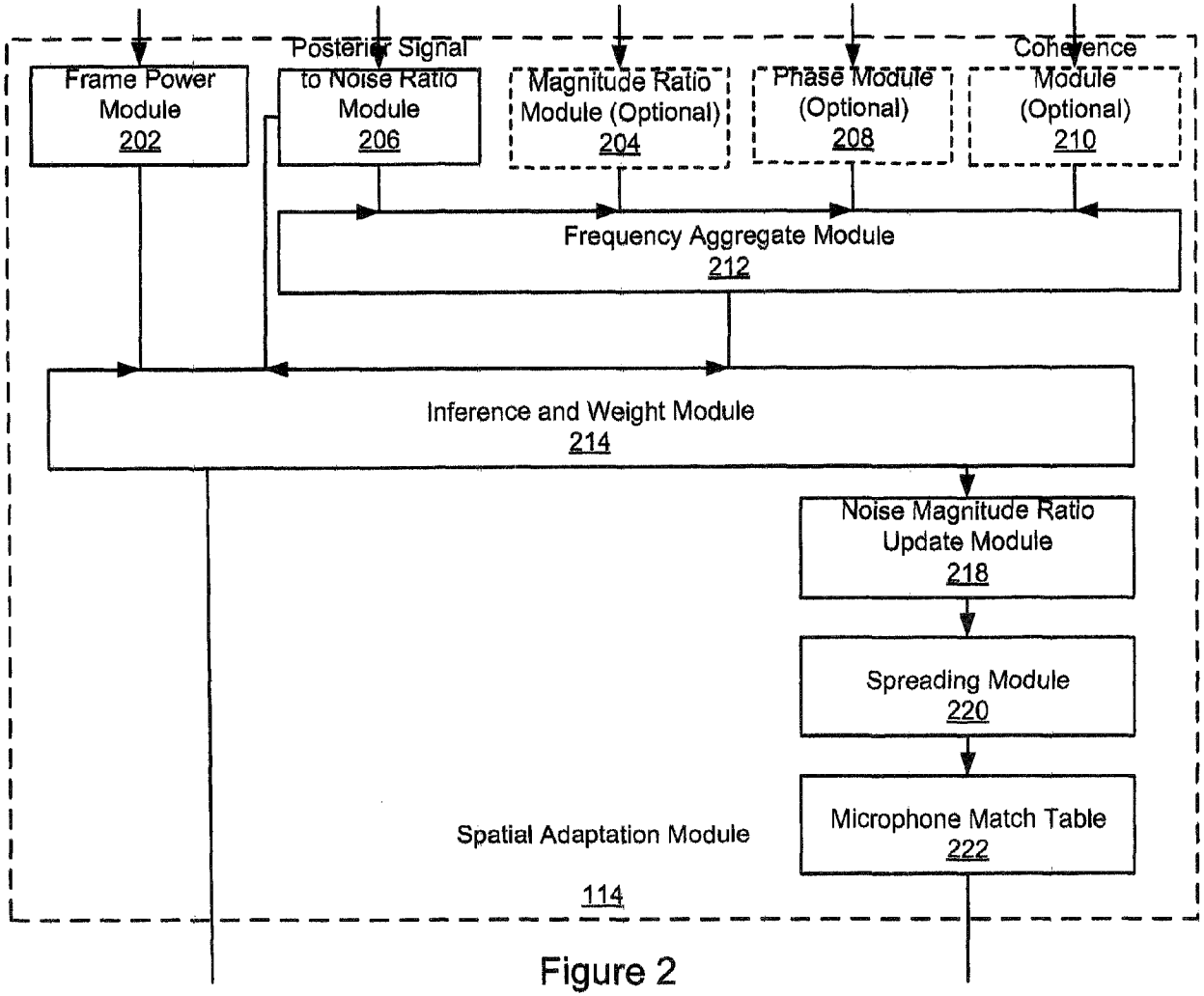
FIG. 2 illustrates a block diagram according to an embodiment of the spatial adaptation system.

FIG. 2 illustrates an embodiment of the spatial adaptation module 114. As illustrated in the FIG. 2 embodiment, spatial adaptation module 114 includes frame power module 202. Frame power module 202 determines the frame power and is coupled with inference and weight module 214. For an embodiment, frame power module 202 determines the frame power, pow, as the mean energy of the time samples x(t) in a frame according to $$pow = \frac{1}{T}\sum_{t=1}^{T} x^2(t)$$

where T is the number of samples in the frame. For an embodiment, the normalization by T is optional. Alternatively, the frame power may be determined as an average across frequency according to $$pow = \frac{1}{K}\sum_{k=1}^{K} |F_k|^2$$

where $F_k$ is the transform coefficient in frequency bin k and K is the number of frequency bins between 0 and half the sampling frequency. For an embodiment, the frequency-domain average frame power may be determined according to $$pow = \sum_{k \in S} |F_k|^2$$

where S is an arbitrary set of frequency bins. For an embodiment, the arbitrary set of frequency bins used are those that contribute to the discrimination between different signal classes such as speech, acoustic noise, microphone self noise, and interferers. In other words, frequency bins that provide information that can be used in the decision of what class the current time frame belongs to. For an embodiment, the arbitrary set of frequency bins excludes frequency bins that may be affected by external disturbances; power line low frequency components (50 or 60 Hz).

Yet another embodiment determines frame power as the average over the band energies according to $$pow = \sum_{i \in Q} FB_i$$

where $FB_i$ the accumulated energy in band i. As discussed above, a set of frequency bins may be selected that contribute to the discrimination between different signal classes.

Magnitude ratio module 204 is optionally included in spatial adaptation module 114. Magnitude ratio module 204 determines the magnitude ratio of converted front microphone signal 110 to the converted rear microphone signal 108. In an embodiment the magnitude ratio in frequency band i is determined according to $$MR_i = 10 \log_{10}(FB_i/RB_i)$$

where $FB_i$ is the energy in frequency band i of the signal 110, and $RB_i$ is the energy in frequency band i of the signal 108.

As discussed above, according to another embodiment magnitude ratio module 204 may be a separate module outside the spatial adaptation module 114. According to the FIG. 2 embodiment, magnitude ratio module 204 is coupled with frequency aggregate module 212. For another embodiment, frequency aggregate module 212 implemented as four frequency aggregate modules, one for each feature (postSNR, magnitude ratio, phase difference, and coherence). As such, the embodiment may have a frequency aggregate module for postSNR, a frequency aggregate module for the magnitude ratio, a frequency module for the phase difference, and a frequency aggregate for coherence. The frequency aggregation for each feature may be determined independently for each feature, according to an embodiment.

Another module coupled with frequency aggregate module 212, according to the FIG. 2 embodiment, is phase module 208. This module determines the phase difference between the front microphone signal 102 and the matched signal 116. The phase module 208 is optionally included in the spatial adaptation module 114. For other embodiments the phase module 208 may be included in the spatial feature module 122.

Coherence module 210 is also optionally included in the spatial adaptation module 114, according to the embodiment illustrated in FIG. 2. The coherence module 210 determines the coherence between microphone signals. As illustrated in FIG. 2, the coherence module is coupled with frequency aggregate module 212.

Posterior signal to noise ratio module 206, as illustrated in the embodiment in FIG. 2, is coupled with frequency aggregate module 212. The posterior signal to noise module is also coupled with the inference and weight module 214. According to an embodiment, the posterior signal to noise ratio module 206, determines the posterior signal to noise ratio ("postSNR"). PostSNR is frequency dependent and determined based on the converted front microphone signal 110, according to an embodiment. The determined postSNR represents signal to noise ratio of the noise source. For an embodiment, the value of postSNR is equivalent to 1 (or 0 dB) when front microphone signal 110 is dominated by a noise source.

The frequency aggregate module 212, according to an embodiment, receives magnitude ratio, postSNR, phase difference, and coherence values from the respective modules, as discussed above. As such, frequency aggregate module 212 aggregates the received values across the frequency band or one or more frequency bins of the signals using averaging techniques. Averaging techniques used may include, but are not limited to, techniques discussed in more detail below and other techniques known in the art. The result of the frequency aggregate module 212 is to determine a scalar aggregate for the magnitude ratio, postSNR, phase difference, and coherence values, according to an embodiment. The frequency aggregate module 212 provides the determined scalar representations of magnitude ratio, postSNR, phase difference, and coherence values to the inference and weight module 214.

For an embodiment the inference and weight module 214 determines the condition of the desired source to determine if adaptation should be performed. For example, the inference and weight module 214 may use three Gaussian mixture models, one for determining a clean desired source (i.e., no noise), one for determining a noise dominated desired source, and one for determining a desired source dominated by an interferer. Examples of interferes include, but are not limited to, source not intended to be captured such as speech source, radio, and/or other source that is misclassified as the desired source.

Based on the results of the three Gaussian mixture models, the inference and weight module 214 determines when and how to update the noise target estimates. Another aspect of the inference and weight module 214, according to an embodiment, is that the module determines when a microphone output is dominated by self noise. The inference and weight module 214, for an embodiment, uses scalar values of frame power ("pow"), phase difference ("pd"), and coherence ("coh") to determine if the output of a microphone is dominated by self noise. If the inference and weight module 214 determines that the output of a microphone is dominated by self noise, the module can disable or discontinue adaptation of the signals by not updating any more output values, such as the noise target. Moreover, inference and weight module 214 may use a maxima follower of the magnitude ratio to determine if an interferer is dominating the desired source. If an interferer is detected the inference and weight module may disable or discontinue adaptation.

In addition, inference and weight module 214 performs adaptation by determining weight values for updating the noise target, according to an embodiment. For some embodiments, the desired source is speech from a near-field source, for example a headset or handset user, but this is not intended to limit embodiments to the capture of only speech or voice sources. For an embodiment, a noise weight is determined such that the noise target convergence rate has its maximum around or near 0 decibels (dB) postSNR. For frames and frequencies that are dominated by the desired source, an embodiment of the inference and weight module 214 determines a source weight such that the target update convergence rate is zero below a predetermined value, for example 10 dB postSNR, and increases with the postSNR up to a predefined maximum value. As described, the weighting system provides protection against misclassified frames, i.e. frames incorrectly classified as a frame dominated by far-field noise or a frame incorrectly classified as the desired source.

As for the embodiment illustrated in FIG. 2, the inference and weight module 214 is coupled with a noise magnitude ratio update module 218. The noise magnitude ratio update module 218 uses the noise target weight or weights determined by the inference and weight module 214 to determine an updated noise target. The noise magnitude ratio update module 218 in the embodiment illustrated in FIG. 2 is also coupled with a spreading module 220.

For embodiments of the spatial adaptation system, the converted front microphone signal 110, converted rear microphone signal 108, and the match signal 116 may be represented by a predetermined number of coefficients of other basis to represent a signal. The number of coefficients is related to the trade off between the resolution desired to achieve optimal results and cost. Cost includes, but is not limited to, the needed hardware, processing power, time, and other resources required to operate at a specific number of coefficients. Typically, the more coefficients used the higher the cost. As such, one skilled in the art must balance the desired results or performance of the system with the cost associated. In some cases the performance of the system increases with a reduced number of coefficients since the variance of a feature is reduced when features are averaged across a frequency band. For an embodiment the number of coefficients of the transform used to represent the converted front microphone signal 110, converted rear microphone signal 108, and the match signal 116 each as 128 coefficients per time frame or time interval. Other embodiments, may use a different number of coefficients determined by the performance to cost analysis described above, thus the number of coefficients used is not intended to be limited to a specific number or range.

According to some embodiments, the values determined by the modules, for example magnitude ratios, coherence, phase difference, noise target weights, desired source weights, postSNR and any other discussed herein, may use the same number of coefficients per time frame as the converted front microphone signal 110 and match signal 116. For other embodiments, the values determined by the modules may be of a different coefficient length. This length may also be determined using a similar performance versus cost analysis as discussed above, thus the number of coefficients used is not intended to be limited to a specific number or range. For an embodiment, the spatial adaptation system uses 32 bands based on 128 frequency bins to represent the values of magnitude ratios, coherence, phase difference, noise target weights, desired source weights, and updated noise target.

For embodiments that use a different number of coefficients or basis to represent the converted front microphone signal 110, converted rear microphone signal 108, and the matched signal 116 than that used for the determined updated noise target a spreading module 220 may be used. FIG. 2 illustrates an embodiment that uses a spreading module 220 to spread the update noise target across the full number of coefficients or basis used for the converted rear microphone signal 108. For example, the updated noise target may be represented by using frequency bands based on frequency bins and the converted rear microphone signal 108 may be represented by using frequency bins defined by 128 coefficients. For such an embodiment, the spreading module is used to transform the updated noise target to a 128 coefficient representation.

For an embodiment, the spreading module maps the determined noise targets (estimated in bands) to frequency bins by interpolating the noise targets in the linear domain according to $$\overline{MR}_{N,n}^{out} = \sum_i w_{n,i} 10^{\overline{MR}_{N,i}/20}.$$

where $\overline{MR}_{N,i}$ is the logarithmic noise target in band i, and $w_{n,i}$ is an interpolation weighting factor. Furthermore, $\overline{MR}_{N,n}^{out}$ is the linear noise target in frequency bin n, which in an embodiment constitutes signal 112.

For other embodiments, the interpolation may be performed in the logarithmic domain and the mapping to the linear domain is done after interpolation. For such an embodiment, a weighted geometric mean may be used instead of the weighted arithmetic mean as described above.

FIG. 2 also illustrates the embodiment including a microphone match table 222 coupled with the spreading module 220. For some embodiments the noise target stored in the microphone match table 222 is applied to the microphone matching multiplier 113 to adapt the converted rear microphone signal 108 so that the logarithmic power equals that of the converted front microphone signal 110 over a frequency range, as discussed above. For some embodiments the microphone match table 222 is updated as determined by the spatial adaptation module 114. For some embodiments the microphone match table 222 is updated every frame. Other embodiments include updating the microphone match table 222 at a predetermined interval.

Figure 3:
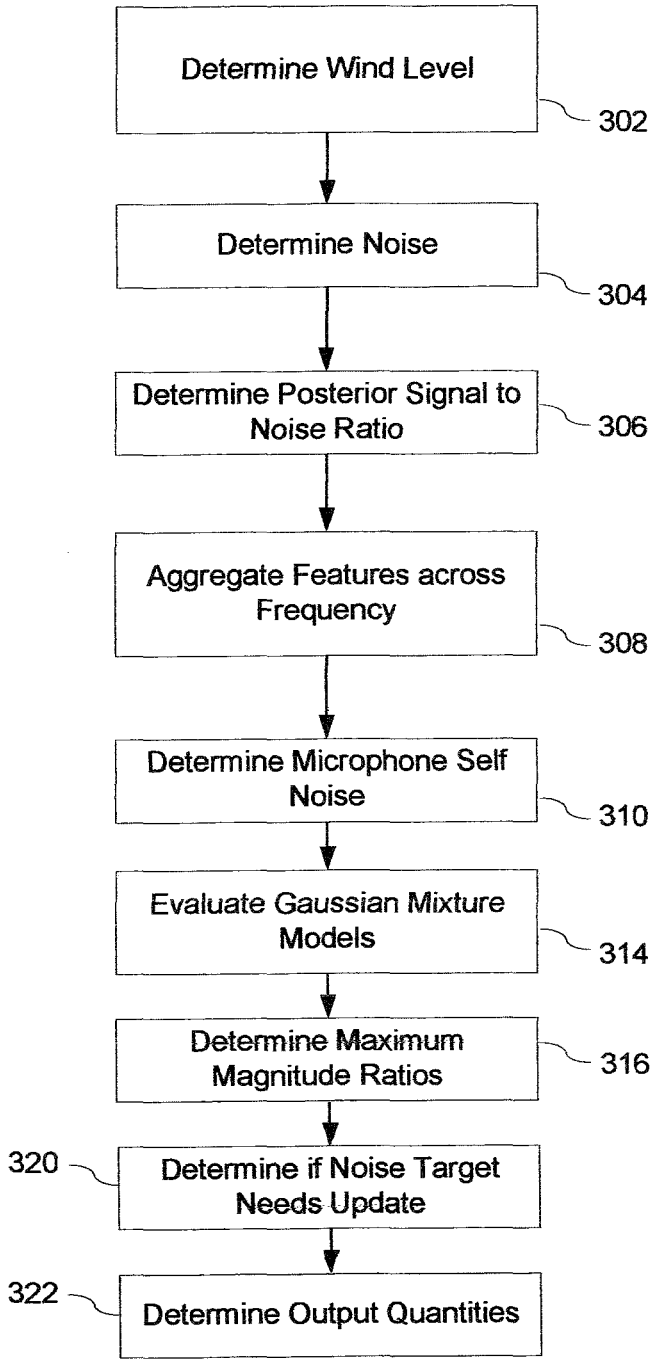
FIG. 3 illustrates a flow diagram for spatial adaptation according to an embodiment of the spatial adaptation system.

FIG. 3 illustrates a flow diagram for spatial adaptation according to an embodiment of the spatial adaptation system. In describing FIG. 3, techniques for determining values discussed above will be described in greater detail. As such, the techniques discussed below may be used for the embodiments discussed above.

At block 302, the embodiment of the spatial adaptation system determines the wind level. For an embodiment, wind level may be determined by any technique as known by a person skilled in the art of spatial adaptation for multiple-microphone sound capture systems. Other embodiments include techniques as set out in U.S. Provisional Patent Application No. 61/441,528; and in U.S. Provisional Patent Application No. 61/441,551, all filed on even date herewith, which are hereby incorporated in full by reference.

At block 304, the system determines the noise. For an embodiment, the system uses the band energies of the converted front microphone signal 110 to determine the background noise band energies, $N_i$. As described above the number of coefficients used to represent signals may be different through out the spatial adaptation system, according to some embodiments. For an embodiment the converted front microphone signal 110, the converted rear microphone signal 108, and the matched signal 116 are represented by a frequency bin. For an embodiment, frequency bins are grouped into bands. According to an embodiment, 128 frequency bins are grouped into 32 bands. For some embodiments, the number of frequency bins in each band varies with the center frequency of the band. In other words, the number of frequency bins in each band is determined based on a given center frequency of that band.

For an embodiment, the band energy in frequency band, i, of the converted front microphone signal 110 is equal to $$FB_i = t_i \sum_n w_{i,n} |F_n|^2$$

where n is the frequency bin, $t_i$ is the band tilt. For an embodiment, band tilt is a normalization factor that levels the band energies of the input. According to an embodiment, the normalization is particular to a type of input, for example speech. The band tilt, according to an embodiment, facilitates tuning since many constants can be made frequency independent. For some embodiments, band tilt is determined empirically over varying conditions with multiple users to provide an optimal operating range for the band tilt. For such an embodiment, the determined band tilt may be stored in a fixed table in the system to be accessed during real-time operation. According to another embodiment, the band tilt may be determined as the inverse of the average desired source band energies.

Figure 5:
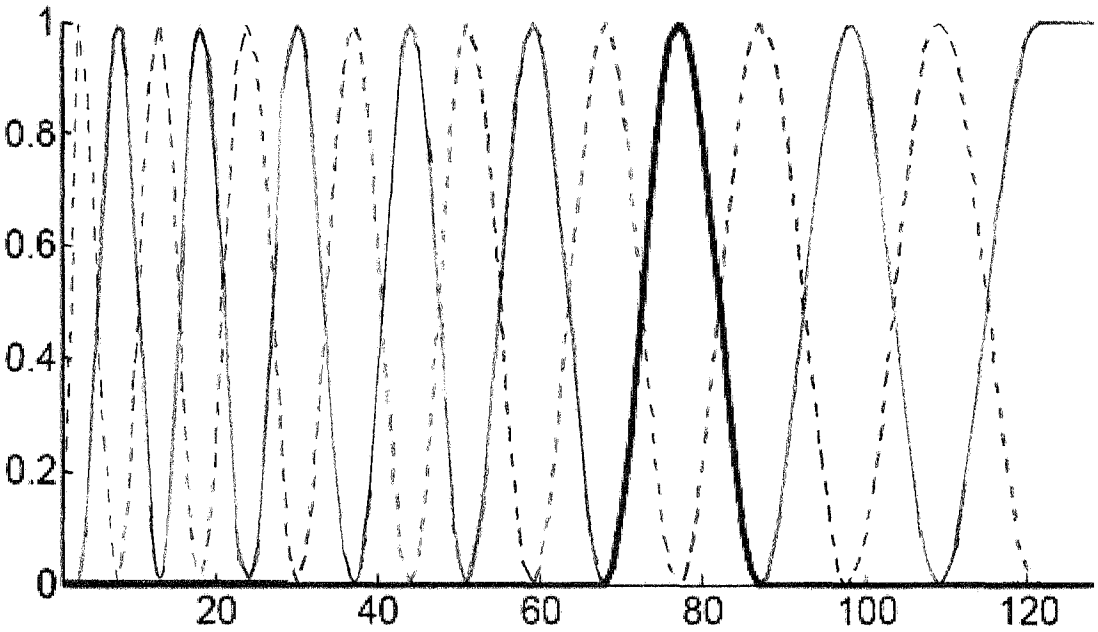
FIG. 5 illustrates banding according to an embodiment of the spatial adaptation system.

In addition, $w_{i,n}$ is the frequency band matrix that weighs together the frequency bin energies with a bell shaped weighting curve centered on the center frequency of the frequency band. Alternatively, $w_{i,n}$ can be interpreted as a frequency-domain window that is non-zero for all the bins (i.e., for all values of n) belonging to band i. In FIG. 5 the frequency domain windows for an embodiment using 128 frequency bins and 16 frequency bands are illustrated. For clarity every second window is depicted using a dashed line. In particular band weights $w_{12,n}$ for n=1, . . . , 128 is illustrated as a thick solid line. For an embodiment, the spatial adaptation system provides for an overlap between bands; in FIG. 5 the overlap is 50% and for example $w_{12,n}$ is zero for n<69 and for n>86.

For an embodiment, the following state variables are maintained:

$$\{N_i\},\{TTR_i\},\{\mathrm{MIN1}_i\},\{\mathrm{MIN2}_i\}$$

where i={1, 2, . . . , 32}, $N_i$ and $\mathrm{MIN2}_i$ track the minimum energy in each of the converted front microphone signal bands, and $\mathrm{TTR}_i$ is a frame counter. For another embodiment, i is not limited to a maximum of 32 bands, but may include any number of bands as is desired to achieve a desired performance of the system. Further, spatial adaptation system may determine values on each band separately. Moreover, a state variable $\{\mathrm{BUF}_i(t)\}_{t=1}^{T}$ may also be used to maintain the last predetermined number of determined energy bands. That is, $\{\mathrm{BUF}_i(t)\}_{t=1}^{T}$ equals the last predetermined number, T, of values of $\mathrm{FB}_i$ determined by the system. For an embodiment, the spatial adaptation system maintains the last four values of $\mathrm{FB}_i$. According to an embodiment, $N_i$ and $\mathrm{MIN2}_i$ are initialized to the maximum floating point value, realmax. For an embodiment, the maximum floating point value depends on the precision of the hardware and/or software platform used for implementation. For another embodiment, the maximum floating point value is determined by the largest band energy that will be encountered by the system. The goal of this is to ensure that for the first time frame we process, the minima followers should detect a new minimum.

Moreover, $\mathrm{TTR}_i$ is initialized to max_ttr. For an embodiment, max_ttr is in the range of about 0.5 seconds and up to and including about 2 seconds. Having a low value of max_ttr makes the noise estimate respond faster to sudden increases in noise band energy levels. Moreover, values of max_ttr that are too low can lead to the minima follower improperly reacting to an increase in band energies of the input that are a result of the desired source. As such, for embodiments, a trade-off is obtained if max_ttr is allowed to be as long as the expected length of a desired sound in a frequency band. For an embodiment, max_ttr is set equal to 1 second. According to some embodiments, max_ttr is frequency dependent. For some embodiments, it is convenient to express the time period max_ttr in a number of time frames instead of in seconds. For example, if the sampling frequency is 8 kHz and the stride (also known as hop-size, or advance) of the transform is 90 samples then 1 second corresponds to approximately 88 time frames, and max_ttr is set to 88.

For an embodiment, the following steps are performed for each time instant (frame) τ and for each frequency band (the frequency band index omitted for clarity) to determine the noise:

Shift in FB into BUF. Compute the mean $\overline{\mathrm{BUF}}$ over the T buffer entries in each band:

$$\overline{BUF} = \frac{1}{T}\sum_{t=1}^{T} BUF(t)$$

If $\overline{\mathrm{BUF}}$<bias·N(τ−1), with bias>1, then set
N(τ)=$\overline{\mathrm{BUF}}$
MIN2=realmax
TTR=max_ttr
3) If $\overline{\mathrm{BUF}}$>=bias·N(τ−1), then set
N(τ)=bias·N(τ−1)
TTR=TTR−1
4) If TTR<=0, then set
N(τ)=min(max(N(τ−1),MIN2),$\overline{\mathrm{BUF}}$)
MIN2=realmax
TTR=max_ttr
5) MIN2=min MIN2,$\overline{\mathrm{BUF}}$)

For such an embodiment, the idea is to have two minima followers running in parallel, one primary (N) and one secondary (MIN2). If the primary follower is not updated for a duration of max_ttr frames, it is updated using the secondary buffer. The secondary buffer also tracks the minimum in each frequency band but is reset to realmax whenever the primary buffer is updated with a new minima. For an embodiment, bias, for the equations above, should to set to provide for rapid response to increasing noise levels, but small enough not to introduce a prohibitively large positive bias in the noise estimate. The use of double minima followers provides for the use of a smaller value of bias. For an embodiment, step 1 above is used to remove outliers. As such, other embodiments include other techniques to remove outlier such as computing the median over $\{\mathrm{BUF}_i(t)\}_{t=1}^{T}$ in each frequency band i, averaging across frequency bands, and any other method known to those skilled in the art.

For other embodiments, the spatial adaptation system may perform post-processing on the output N of the double minima follower. Post-processing may include, but is not limited to, smoothing across time frames, smoothing across frequency bands, and other techniques known to those skilled in the art. Furthermore, although the description above refers to processing done in frequency bands, other embodiments include processing directly on frequency bins. Yet another embodiment includes, skipping steps 1-5, as described above, for the first frame and setting N and MIN2 equal to the band energy in each frequency band.

At block 306, the system determines the posterior signal to noise ratio ("postSNR"). For an embodiment, the postSNR is computed based on the band energies of the converted front microphone signal 110, $FB_i$, according to the equation:

$$postSNR_i = 10\log_{10}\frac{FB_i}{N_i}$$

where $N_i$ is the background noise band energies, as discussed above.

At block 308, according to the embodiment illustrated in FIG. 3, the system aggregates features across frequencies. For an embodiment the features include postSNR, magnitude ratio, phase difference, and coherence. According to an embodiment, the scalar aggregate of postSNR ("psnr") is determined by calculating nVoiceBands and dividing the number by the number of frequency bands. For an embodiment, nVoiceBands is the number of frequency bands where postSNR exceeds a threshold predetermined for that frequency band. For such an embodiment, the scalar aggregate of postSNR is a value between 0 and 1. For an embodiment, a 10 dB threshold is used for a frequency band. According to other embodiments, a plurality of thresholds may be used each corresponding to a predetermined frequency band.

For other embodiments, the scalar aggregate of postSNR may be determined using techniques including, but not limited to, determining the arithmetic or geometric average of postSNR over a set of frequency bands, the median of postSNR over a set of frequency bands, where the set of bands contain the bands that provide for the greatest power to discriminate between the desired source and noise.

For an embodiment, the scalar aggregate of the magnitude ratio is determined as $$mr = \frac{1}{|I|}\sum_{i\in I} MR_i$$

where the set of frequency bands, I, is meant to capture the range of frequencies where the magnitude ratio is useful as a discriminator between near-field speech and far-field sounds. According to an embodiment, the set of frequency bands, I, may also be determined as discussed above.

For an embodiment, the frequency band energies of the converted rear microphone signal 108 are computed before microphone matching. For embodiments, the magnitude ratio is determined useful as a discriminator by testing different sets of frequency bands in the aggregate and evaluate the performance of the spatial adaptation system for each set. The set of bands, I, is then determined based on the set that maximizes some objective or subjective performance measure of the system as could be defined by a person skilled in the art of spatial adaptation systems. Alternatively, a set of bands, I, may be determined by exposing the spatial adaptation system to known sources such as one for speech dominated signals and one for noise dominated signals and comparing the statistical distributions for values of mr over a large number of time frames. These distributions may then be evaluated by looking at plots of the distributions or evaluating the Kullback-Leibler distance between the distributions to determine a set of bands, I, where mr is most useful at discriminating between sources such as a speech dominated source and a noise dominated source.

For an embodiment, the phase difference in a frequency band i is determined according to $$PD_i = \angle CB_i - \pi/2$$

where the banded cross energy spectrum $CB_i$ is determined according to $$CB_i = t_i \sum_n w_{i,n} F_n R_n^*$$

where $w_{i,n}$ is the frequency band matrix described above, $t_i$ is the band tilt described above, and $F_n$ and $R_n$ are the complex valued transform coefficients in bin n of the converted front microphone signal 110 and converted rear microphone signal 108, respectively. The phase angle operation $\angle$ determines the angle of the polar representation of the complex valued quantity $CB_i$, using methods well known to those skilled in the art, and gives an angle in radians in the interval $-\pi,\pi$. According to an embodiment, subtracting $\pi/2$ is optional and can be beneficial to avoid phase wrapping at higher frequencies. For an embodiment, front microphone 102 is closer to the desired source. For a particular embodiment, the distance of front microphone 102 from the rear microphone 104 as used headsets is less than 45 mm, for example. As such, phase wrapping should not occur for frequencies up to 4 kHz, in theory, but some margin is useful to account for the stochastic nature of instantaneous phase differences.

For an embodiment, the scalar aggregate of the phase difference is determined by $$pd = \frac{1}{|I|}\sum_{i\in I}\left(PD_i - \overline{PD}_i^{fixed}\right)^2$$

where according to an embodiment, $I=\{1, 2, \ldots, 32\}$. For other embodiments I, the set of frequency bands, may be determined as discussed above. For an embodiment, $\overline{PD}_i^{fixed}$ is determined offline, not in real time, by averaging values of $PD_i$ where the average is determined based on data from the desired source, recorded over a range of operating conditions and users. The aim is that the $\overline{PD}_i^{fixed}$ determined offline represents a typical phase difference that clean speech exhibits during runtime. Thus, during runtime pd is typically close to 0 for time frames that are dominated by the desired source. Furthermore, for time frames dominated by far-field noise, or any sound that has a phase difference spectrum different from $\overline{PD}_i^{fixed}$, pd is typically distinctly larger than 0.

In an embodiment the coherence in a frequency band i is determined according to $$COH_i = \frac{|CB_i|^2}{FB_i RB_i}$$

where $FB_i$ the energy in frequency band i of the signal 110, $RB_i$ is the energy in frequency band i of the signal 108, and $CB_i$ is the banded cross energy spectrum as described above.

The scalar aggregate of coherence is determined by $$coh = \frac{1}{|I|}\sum_{i \in I} COH_i$$

where according to an embodiment, I={5, 6, . . . , 32}. For other embodiments I, set of frequency bands, may be determined as discussed above.

At block 310, the system determines if microphone self noise dominates the signal. According to an embodiment, self noise detection is based on the aggregated features including the scalar aggregated of frame power ("pow"), the scalar aggregate of phase difference ("pd") and the scalar aggregate of coherence ("coh"), all discussed in more detail above. For some embodiments, if either of these two conditions are fulfilled then the system determines that self noise is detected according to:

pow<pow_threshold1 or (pow<pow_threshold2) and (pd>pd_threshold) and (coh<coh_threshold).

For an embodiment pow_threshold1<pow_threshold2. More specifically, pow_threshold1 is related to the long term average frame power of microphone self noise, according to an embodiment. For some embodiments, related to the long term average frame power over a plurality of microphones. A safety margin is added, for some embodiments, to this long term average frame power to yield pow_threshold1. For an embodiment, the safety margin ranges from about 2 dB up to about 10 dB. This range may depend on the variance in microphone sensitivity between microphones, according to some embodiments. For an embodiment, the larger the uncertainty of microphone sensitivity the larger the required margin. The safety margin also accounts for the stochastic nature that the scalar aggregate of frame power, pow, exhibits when it varies around the long term average frame power, according to an embodiment. For some embodiments, pow_threshold2 is determined according to pow_threshold2=pow_threshold1+margin2

For an embodiment, margin2 is around 10 dB. For other embodiments, margin2 may be determined empirically over a predetermined range of operating characteristics and users such that the performance of the spatial adaptation system meets the demands as defined by a person skilled in the art of spatial adaptation systems. For some embodiments, pow_threshold1 is equal to about −80 dB and pow_threshold2 is equal to about −70 dB.

For some embodiments, when self noise is detected no spatial adaptation is performed. Moreover, some embodiments assume the presence of self noise for a predetermined amount of time after the detection of self noise. According to an embodiment, the predetermined amount of time is between 2 frames and 10 frames. For other embodiments, the predetermined amount of time is 5 frames.

The system at block 314, according to an embodiment, evaluates Gaussian mixture models to classify a desired source. For an embodiment, the Gaussian mixture models are based on the aggregated features, or any subset thereof, of postSNR ("psnr"), phase difference ("pd"), coherence ("coh"), and aggregated magnitude ratios ("mr") where the aggregated magnitude ratios, according to an embodiment, can be based on quantities like MR, MR−MRmax, MR−MRmin, MR/MRmax, MR/MRmin, (MR−MRmin)/(MRmax−MRmin), or any other function of MR known to those skilled in the art or as described below. These features, according to an embodiment, make up the feature vector y=(psnr, pd, coh, mr). For an embodiment, each aggregated feature is mapped to the logarithmic domain to make the distribution of features better suited for modeling using Gaussian mixture models. As such, psnr and coh are mapped using log(psnr/(1−psnr)). In addition, pd is mapped using log(pd). Other embodiments may use alternative mappings as are known in the art.

The probability distribution function of the feature vector is modeled by one or more Gaussian mixture models, where one model is optimized for a source or voice dominated signal (clean voice or speech), and one model is optimized for noise dominated signals (noise), according to an embodiment. During runtime, a feature vector y=(psnr, pd, coh, mr) is computed for every frame, according to an embodiment, and the likelihoods (the values of the Gaussian probability distribution functions for a given feature vector), $p_{y|S}$ and $p_{y|N}$, are computed for the speech and noise Gaussian mixture model respectively. For an embodiment, Bayes' rule is used to determine the probability of a source dominated signal conditioned on the observed feature vector such as $$P_{S|y}=p_{y|S}P_S/P_y$$

where $P_S$ is the apriori probability of a source dominated signal. For an embodiment, $P_S$ is set to 0.5. A value of 0.5 puts no prior assumption on what to expect from the observed data. In other words, it is equally likely that we will encounter a source dominated signal as encountering a noise dominated signal. For other embodiments, choosing other values for $P_S$ provides an opportunity for tuning the decision making in favor of either the source dominated signal (set $P_S$>0.5) or noise dominated signal (set $P_S$<0.5). Further, $$P_y=p_{y|S}P_S+p_{y|N}P_N$$

where $P_N$ is the apriori probability of a noise dominated signal and $P_N=1-P_S$. For an embodiment, $P_N$ is set to 0.5. The probability $P_{N|y}$ of noise dominated signal conditioned on the observed feature is determined by $P_{N|y}=1-P_{S|y}$.

According to an embodiment, noise is inferred if ($P_{N|y}$>0.7) and (nVoiceBands<=1) or $P_{N|y}$>0.85. In contrast, the desired source is inferred if ($P_{N|y}$>0.7) and (nVoiceBands>=4) or $P_{S|y}$>0.85. In all other cases, the uncertainty is determined to be too high and no spatial adaptation is done. In other words, the spatial adaptation system does not update any weights, according to an embodiment. For other embodiments, the threshold values for $P_{N|y}$, $P_{S|y}$, and nVoiceBands may be chosen as any value based on desired performance characteristics for a spatial adaptation module. For an embodiment, nVoicebands is not used to infer noise.

For an embodiment, a spatial adaptation system may use a Gaussian mixture model based inference described herein that indicates that a frame is both speech and noise, depending on how you choose the thresholds for $P_{S|y}$ and $P_{N|y}$ as exemplified above with 0.7 and 0.85, respectively. For such an embodiment, it can either 1) be inferred that the uncertainty is too high and no updating should occur, or 2) be decided to update using both the method when noise dominates as described below, and using the method when the desired source dominates, also described below. For such an embodiment, the postSNR based weighting as discussed below, provides for a soft decision.

Additionally, for an embodiment, the likelihood of an interferer dominated signal, $p_{y|I}$, of the observed feature vector conditioned on an interferer Gaussian mixture model is determined. For an embodiment, if $$p_{y|S}/p_{y|I}<c1$$

or $$p_{y|N}/p_{y|I}<c2$$

the current frame is determined to contain an interferer and no spatial adaptation is done.

Another embodiment employs this condition to infer an interferer and turn off adaptation in that frame according to:

$$p_{y|S}/p_{y|I}<c1$$

and $$p_{y|N}/p_{y|I}<c2.$$

For an embodiment, the above tests are implemented in the logarithmic domain. For an embodiment, c1 and c2 are currently set to 1 (or 0 in the logarithmic domain). For some embodiments, when an interferer is detected, as discussed above, the interferers are treated as noise and the spatial adaptation system dynamically adapts as described for the case when far-field noise is detected.

Similar as discussed above, some embodiments assumed the presence of an interferer for a predetermined amount of time after the detection of an interferer. According to an embodiment, the predetermined amount of time is between 2 frames and 10 frames. For other embodiments, the predetermined amount of time is 5 frames. For an embodiment, when a desired source is detected in a frame, a number of consecutive frames are blocked for noise target adaptation based on noise, but noise target adaptation based on the desired source is still possible.

At block 316, the spatial adaptation system determines the maximum magnitude ratios. For an embodiment, the maximum magnitude ratio may be used to protect against interfering talkers by comparing the magnitude ratio of the current frame with a threshold derived from an estimate of the maximum ratio that could be produced by a near-field talker (e.g., a headset user). The maximum magnitude ratio is estimated, according to an embodiment, by a maxima follower. For an embodiment, a maxima follower may be maintained in a state variable. For example, a state variable such as mr_max may be used. According to an embodiment, the state variable is updated according to the following equation:

$$mr_max=max(mr_max-mr_bias,mr_median)$$

where mr_bias is a small positive number, mr_median is the median over a buffer of the most recent scalar aggregates of magnitude ratios, discussed above, mr. For an embodiment, mr_bias is set to 0.5 dB/second which is translated to a value in dB/frame given the stride of the input signal conversion module 106 and the sampling frequency. This value is a compromise between adapting to changes in the maximum ratio (e.g., caused by change in acoustic paths between source and microphones), and stability of the estimate. For an embodiment, the purpose of the mr_median operation is to remove outliers, and any method known to those skilled in the art can be used like, e.g., the arithmetic mean, geometric mean. For some embodiments, the buffer size is equal to one frame. According to some embodiments, the state variable is updated every frame. For other embodiments, the state variable is updated after a predetermined amount of frames. For an embodiment, a threshold used for interferer rejection based on mr_max is determined according to $$thres_interferer=mr_max-interferer_margin$$

where in one embodiment interferer_margin is set to 2 dB.

For an embodiment, the level difference between two microphones positioned in end-fire configuration relative to a near-field source, is typically large when the microphones are subjected to acoustic stimuli from the near-field source, and the level difference is low when the stimuli is far-field sounds. Thus, based on the level difference near-field and far-field sounds can be discriminated. The potential is increased the closer the two microphones are to the near-field sounds source.

For an embodiment, levels (also called magnitudes) can be compared on a logarithmic scale, e.g., in dB, and then it is appropriate to talk about level differences, or levels can be compared on a linear scale, and then it is more appropriate to talk about ratios. We will in the following loosely use the term magnitude ratios, and by that refer to both the logarithmic and linear case or any other mapping of level differences known to those skilled in the art. Time-frequency (TF) analysis is done separately on the microphone signals and any transform or filter bank can in principle be applied. Often complex valued, short term Fourier transforms (StFTs), or real-valued discrete cosine transforms (DCTs) are applied on time blocks (also called time frame) of length on the order of 10-20~ms and with a frequency resolution of 50-100~Hz, and the subsequent processing is done on the frequency coefficients.

For an embodiment, grouping, or banding, of frequency coefficients, averaging of signal energies and other quantities within these groups, or frequency bands, and subsequent processing based on one aggregate quantity representing the group or band can be beneficial. The magnitude ratios that are exploited often change rapidly, e.g., in case the near-field and/or far-field sound is speech, the magnitude ratios change approximately every 10-20 ms. Similarly the magnitude ratios are frequency dependent and it may be beneficial to analyze the ratios in frequency bands with a bandwidth of on the order of 50-100 Hz. In the following it is understood that when we discuss magnitude ratio associated quantities and associated processing, that it is done separately, and possibly independently in each time frame, and in each frequency band of the time frame. The term microphone is understood to represent anything from one microphone to a group of microphones arranged in a suitable configuration and outputting a single channel signal.

For an embodiment of the method presented here relies on that one microphone (or group of microphones) is closer to the near-field sound source than the other microphone. The microphone closest to the near-field source is called near-field microphone, and the microphone farthest away from the near-field source is called the far-field microphone. The magnitude ratio MR can be computed like the ratio between the energy of the near-field microphone and the energy of the far-field microphone. The inverse of this definition is also possible and the methods described below apply also to this case; the role of maxima and minima and their relation to near-field and far-field sounds is just reversed in this case.

According to an embodiment, using magnitude ratios for discrimination is that the microphones have different sensitivity, i.e., two microphones subject to the exact same acoustic stimuli output different levels; we say that the microphones are mismatched. Thus, a far-field sound that subjects the microphones to the same level (but different phase) leads to magnitude ratios that vary depending on the microphone pair, and similarly for near-field sounds. Depending on the magnitude of the microphone mismatch, and depending on the difference in magnitude ratios for near- and far-field sounds it may be impossible to discriminate near- and far-field sounds based on magnitude ratios.

For an embodiment, the acoustic transfer functions between the microphones and the near-field and far-field sources may change during run-time use of the system, which will change the expected magnitude ratios. For example, the near-field source may exhibit an average magnitude ratio of say 10 dB in one scenario and as a simple discrimination rule embodiments of the system classify all time frames and frequency bands with a magnitude ratio that is less than 5 dB as far-field sounds. Consider, a change in the acoustics that causes the near-field source to exhibit an average magnitude ratio of 2 dB. Such a change is likely to cause failure in the discrimination between near- and far-field sounds.

For an embodiment, the spatial adaptation system provides microphone matching so that matching the microphones during manufacturing is minimized or not necessary. This minimizes the time consuming and/or costly manufacturing steps. An embodiment of the system, estimates the microphone mismatch during real-time use of the device, and also compensates for the mismatch during real-time use. For embodiments magnitude ratio minima and maxima followers may be used for the spatial adaptation system.

For an embodiment, the minima and maxima followers track the minimum and maximum magnitude ratios respectively over time, and that an embodiment of the methods may be applied separately and possibly independently in each frequency band. In an embodiment, both the minima and maxima follower employ a buffer of K past magnitude ratios: $\{MR(n-K+1), \ldots, MR(n)\}$ where n is a time frame index. An output MRmax of the maxima follower is produced every time frame as the maximum value in the buffer. An output MRmin of the minima follower is produced every time frame as the minimum value in the buffer, according to an embodiment.

For an embodiment, an observation is that MRmin is an estimate of the average (over several time frames) MR value exhibited by far-field noise, and MRmax is an estimate of the average MR value exhibited by near-field sounds. Employing a buffer provides for the followers to adapt if for example the acoustic transfer function changes as described above. For example, if the near-field source is moved further away from the near-field microphone, the average MR will decrease but as long as the buffer contains values from before the change, MRmax will not reflect this change. As the last value is shifted out of the buffer MRmax will adjust to the change. A change in the acoustics leading to an increase in the average MR is reflected by MRmax, according to an embodiment.

Similarly, MRmin will adapt to changes leading to a decrease in the average MR, but will adapt to changes leading to increased average MR values once the buffer has shifted out the MR values from before the change, according to an embodiment.

For an embodiment, the choice of buffer length is determined for the operation of the followers and the subsequent use of MRmax and MRmin in near-/far-field sounds discrimination. For an embodiment of the method, such a method detects when a time frame and frequency band contains no acoustic stimuli, and that the buffer is not updated for those time frames and frequency bands, see embodiments of methods for microphone self noise detection presented herein. According to some embodiments, four cases illustrate the considerations that may be used for choosing length of buffers:

For MR minima following, and for near-field sources that have an on-and-off character in time frames and in frequency bands, such as, e.g., speech, and for far-field sounds that are more continuous in activity (in particular in time), the buffer length is chosen to be roughly as long (measured in for example number of time frames) as the expected duration of a near-field activity in a frequency band, or longer. The buffer lengths can thus be frequency dependent in some applications.

Similarly, for MR maxima following, and far-field sources that have an on-and-off character in time frames and in frequency bands, such as, e.g., speech, and for continuous activity near-field sounds, the buffer length is chosen to be roughly as long the expected duration of a far-field activity in a frequency band, or longer. The expected activity duration for speech is on the order of 0.2 s up to 5 s. For an embodiment, using too a long a buffer extends the time to adapt to certain changes in acoustic transfer functions increases, as described above.

For minima following, in case the near-field source has a continuous activity, and the far-field source has a sparse (in particular in time) activity, such as speech, the buffer length is chosen such that it bridges the gaps between far-field source activity, i.e., the length is chosen equal to or longer than the longest expected pause in activity in a frequency band. Again this may be frequency dependent.

Similarly for maxima following in case the far-field source has a continuous activity, and the near-field source has a sparse (in particular in time) activity, such as for speech, the buffer length is chosen such that it bridges the gaps between near-field source activity.

The length of speech pauses varies with conversational style, and the character of the communication situation. The choice of buffer length in cases 3 and 4 is as long as is tolerable and again using too a long a buffer extends the time to adapt to certain changes in acoustic transfer increases, according to some embodiments.

The MR values that go into the buffer may be preprocessed to for example remove outliers and to provide some smoothing, for an embodiment. Outlier removal and smoothing can be done across time frames, or across frequency bands within a frame, or both. Techniques for outlier removal and smoothing include, but are not limited to, median filtering, and arithmetic and geometric averaging. Any such method known to those skilled in the art may be applied. The amount of smoothing and the number of time frames and frequency bands to include in for example median filtering is depending on the statistics of the MR stochastic process, and can be determined experimentally.

For an embodiment, the output of the minima and maxima search may be post-processed to for example provide smoothing and/or compensation for the min/max bias. The search for the minimum in the buffer as described above, can be replaced by letting MRmin in each time frame be the k:th smallest value in the buffer. For an embodiment, k is set to compensate for the bias that is introduced by the minima search. Similarly the search for the maximum in the buffer as described above, can be replaced by letting MRmax in each time frame be the k:th largest value in the buffer, and with for an embodiment k may be set to such that the bias introduced by the maxima search can be compensated for.

For an embodiment, magnitude ratio minima and maxima followers can be implemented without the use of buffers over which the minima and maxima is searched. Consider first minima following. An estimate of the minimum magnitude ratio MRmin(n) in time frame n (and in a particular frequency band) can be computed like MRmin(n)=min (MRmin(n−1)+MRbias, MR(n)) where MRmin(n−1) is the estimate of the minimum magnitude ratio in time frame n−1, MRbias is a non-negative constant, and MR(n) is the magnitude ratio of the current time frame. The considerations in the choice of value of MRbias, for an embodiment, are similar to the considerations in the choice of buffer size above. Smaller values of MRbias correspond to using longer buffers, and larger values of MRbias corresponds to using shorter buffers, according to an embodiment.

Consider next maxima following according to an embodiment. An estimate of the maximum magnitude ratio MRmax (n) in time frame n (and in a particular frequency band) can be determined by MRmax(n)=max(MRmax(n−1)−MRbias, MR(n)) where MRmax(n−1) is the estimate of the maximum magnitude ratio in time frame n−1, MRbias is a non-negative constant (not necessarily the same as in the minima follower), and MR(n) is the magnitude ratio of the current time frame. Also here, smaller values of MRbias correspond to using longer buffers, and that leads to good stability of the estimate, according to an embodiment. This means that MRmax maintains an estimate of the average magnitude ratio for near-field sound sources even through time periods with no activity from the near-field source. A smaller value of MRbias also leads to slower adaptation in case changes in acoustic transfer function leads to a lower average magnitude ratio for near-field sound sources, according to an embodiment. And again for an embodiment, larger values of MRbias correspond to using shorter buffers. This leads to quicker adaptation to decreasing average magnitude ratios caused by changes in the acoustic transfer function, but can also lead to severe bias if a long time period passes without any activity from the near-field source, and activity from the far-field source during this period. In an embodiment, where the near-field source is speech, and the far-field source is noise, MRbias is set to 0.5 dB/second as a compromise between adaptivity, and stability.

The benefit, for an embodiment, of the latter two versions of MR minima and maxima estimators that do not employ buffers is that the computational complexity can be lower, and the memory requirement can be lower compared to buffer based minima and maxima estimators, since there is no need to search for the minimum and/or maximum, and there is no need to store the buffer.

For an embodiment, the system pre-processes the magnitude ratios MR(n) that go into the min and max operations (without buffers and by employing an additive/subtractive bias). This pre-processing can be similar to that described above for buffer based minima and maxima following, i.e., it can involve outlier removal and smoothing by median filtering, arithmetic, or geometric averaging or any method for outlier removal or smoothing known to those skilled in the art. Furthermore the outputs MRmax(n) and MRmin(n) may be post-processed in ways similar to those for the buffer based methods.

For an embodiment, the additive/subtractive methods for minima and maxima following can be implemented using any of the following variations to introduce bias: MRmax (n)=max(MRmax(n−1)−MRbias, MR(n)) with MRbias>=0; especially suited for magnitude ratios computed in the logarithmic domain (e.g., in dB) MRmax(n)=max(MRmax (n−1)/MRbias, MR(n)) with MRbias>=1; especially suited for magnitude ratios computed in the linear domain MRmax(n)=max(MRmax(n−1)^MRbias, MR(n)) with 0<MRbias<=1 The corresponding methods for minima following are easily derived from the above to those skilled in the art. There are other methods to introduce bias known to those skilled in the art that do not change the fundamental principle of an embodiment described herein.

As for the buffer based methods the additive/subtractive methods presented above assume that there is a method that detects when a time frame and frequency band contains no acoustic stimuli, and that MRmin(n) and MRmax(n) are not updated for those time frames and frequency bands, according to an embodiment.

As described above, MRmax can be regarded as an estimate of the average magnitude ratio that near-field sounds exhibit. For an embodiment, MRmax provides a reference to which the magnitude ratio computed in each frame can be compared for discrimination.

Thus a discriminator based on MRmax defines a threshold T relative to MRmax: T1=MRmax−margin1 and infers a dominant near-field source in a particular time frame and frequency band if MR>T1 in that time frame and frequency band, for an embodiment. A dominant far-field source is inferred if MR<T1. In an embodiment, margin1 is set to 2 dB. In another embodiment margin1 is different in different frequency bands (i.e., it is frequency dependent).

For an embodiment, a soft decision can be constructed by mapping the difference MRmax-MR to, e.g., the interval [0,1] and let 1 indicate near-field source present with probability 1 and let 0 indicate that a far-field source is present with probability 1. Several such mappings can be constructed by those skilled in the art. Similarly, ratios like MRmax/MR or MR/MRmax can provide for a soft decision and mappings to the interval [0,1] can easily be constructed by those skilled in the art.

Quantities like MRmax-MR, and MR/MRmax can be combined with other features that indicate near- and far-field sounds like, e.g., coherence between the microphones, and phase differences between microphones, and also non-spatial features like for example posterior SNR as described below, for an embodiment. Inference based on such combinations can provide better discrimination performance and at least an embodiment are presented below. In an embodiment, the near-field source is speech and the far-field source is noise and the methods presented above are used to detect when far-field noise is present in a particular time frame and frequency band, the far-field noise being for example an interfering voice. Discriminators based on MRmin can be constructed similarly to those based on MRmax above. Define a threshold T2

$$T2=\text{MRmin}+\text{margin2}$$

A dominant near-field source in a particular time frame and frequency band is inferred if MR>T2 in that time frame and frequency band. A dominant far-field source is inferred if MR<T2. margin2 may be frequency dependent.

Soft decisions similar to those based on MRmax above can be constructed based on, e.g., MR−MRmin, or MR/MRmin, and is straightforward to those skilled in the art. We note that the quantity MR−MRmin (with these quantities computed in the logarithmic domain) is similar to the magnitude ratio that would result if the microphones were matched since MRmin is an estimate of the average (over time frames) MR for far-field sounds, and far-field sounds subject the same level of stimuli in the two microphones. For an embodiment, the quantity MR/MRmax is also a type of microphone matching but there is an uncertainty about the magnitude ratio difference due to the difference in acoustic transfer functions from the near-field source to the microphones. Discriminators based on both MRmax and MRmin according to an embodiment are discussed next.

Consider a threshold T3=MRmin+(MRmax−MRmin)*alpha where for example T3=(MRmax+MRmin)/2 if alpha=0.5. A dominant near-field source in a particular time frame and frequency band is inferred if MR>T3 in that time frame and frequency band. A dominant far-field source is inferred if MR<T3; alpha may be frequency dependent, for an embodiment. According to an embodiment, such a discriminator that employs both the maximum and the minimum MR has the advantage of easier tuning of the threshold parameter alpha compared to tuning margin1 and margin2.

According to an embodiment, soft decisions similar to those presented above can be constructed by determining, for example, the quantity (MR−MRmin)/(MRmax−MRmin) and mapping that to the interval [0,1](it can and will happen that MR<MRmin and that MR>MRmax because of the stochastic nature of the magnitude ratio computed in a particular time frame and frequency band, hence the need for a mapping). The soft decision variables can be used as features in general classification schemes known to those skilled in the art.

For an embodiment, the features based on functions of MRmax and MR or functions of MRmin and MR, or functions of MRmax, MRmin, and MR, can be included in more advanced inference, involving for example Gaussian mixture model (GMM) based methods, hidden Markov (HMM) model based methods, or other generic classification methods known to those skilled in the art. As an illustration of a method known to those skilled in the art a method based on GMMs is presented next. For clarity, only MR based features are included and it is understood that the method can be extended by those skilled in the art to include other features.

For an embodiment, a GMM (one for each frequency band) is optimized offline to model the distribution of say MR−MRmin from near-field training data. Similarly, another GMM is optimized on the distribution of MR−MRmin from far-field training data. During runtime, for each frame the likelihoods of the MR−MRmin feature of the current frame is evaluated given the GMMs. If the likelihood of the near-field GMM is the highest it is inferred that the near field source dominates in that frequency band and time frame and vice versa in case the far-field GMM has the highest likelihood. The likelihoods of the GMMs can be averaged over time frames for a more reliable decision, and soft decisions can be computed according to methods known to those skilled in the art.

As used herein, magnitude ratios MR is understood to be interpreted as any of the following quantities: MR, MR−MRmax, MR−MRmin, MR/MRmax, MR/MRmin, (MR−MRmin)/(MRmax−MRmin), or any other function of MR known to those skilled in the art.

According to an embodiment, the spatial adaptation system maintains a variable, vad. This variable is used to determine when to update the noise targets. For an embodiment, the variable is defined such that when the variable equals 1, a source dominated signal is detected. When the variable equals 0 a noise dominated signal is detected. And, when the variable is equal to −1 no decision can be made, for example because the uncertainty is too high. These variables are set using the Gaussian mixture model (GMM) based inference discussed above. In case the GMM based inference indicate both desired source and noise, as discussed above, the system sets vad=2.

At block 320, the spatial adaptation system determines if the noise target should to be updated. For an embodiment, the noise target is updated if $$vad=0$$

where 1 means a source dominated signal is detected, 0 means a noise dominated signal is detected, −1 means no decision can be made, and 2 means both source dominated signal and noise dominated signal has been detected.

FIG. 3 illustrates a flow diagram for updating source weights according to an embodiment of the spatial adaptation system. For an embodiment, the noise target is updated when a source frame is detected using a modified instantaneous magnitude ratio (see below) if $$vad=1 \text{ and } mr>\text{thres_interferer}.$$

At block 322, the system determines the output quantities i.e. the noise targets. According to an embodiment, the updated noise targets are subject to limiting. The limits of the noise targets, and consequently the limits of the amount of modification done in module 113, are set so as to not allow modification larger than the expected largest variation in microphone sensitivity.

Figure 4:
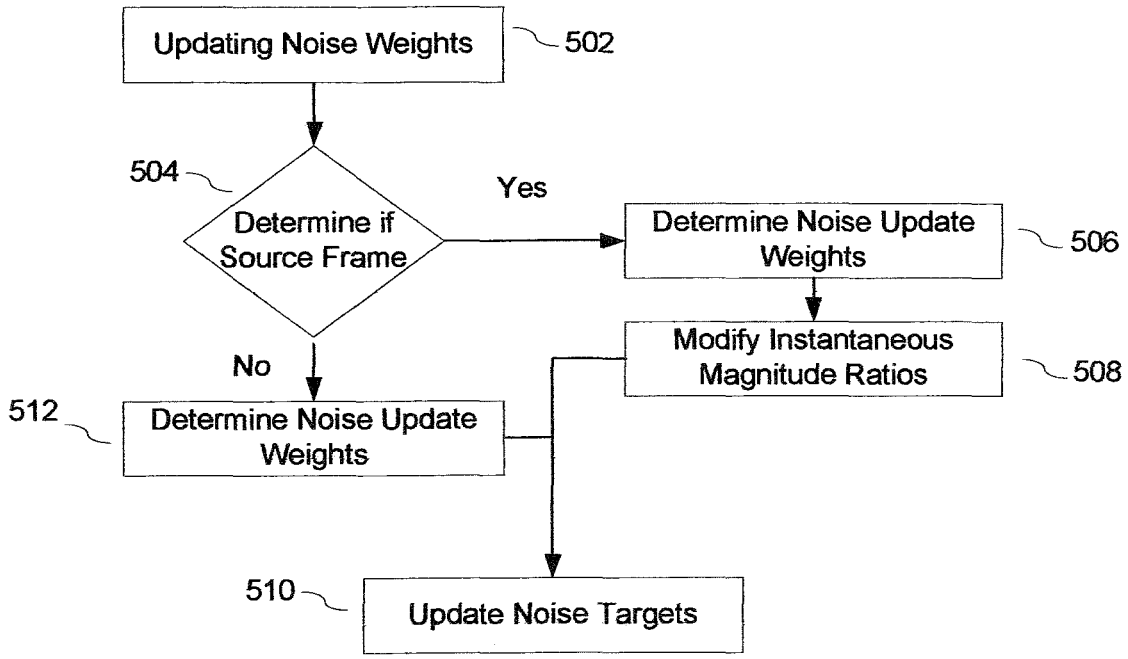
FIG. 4 illustrates a flow diagram for updating noise target weights according to an embodiment of the spatial adaptation system.

Referring now to FIG. 4, FIG. 4 illustrates a flow diagram for updating noise target weights according to an embodiment of the spatial adaptation system. At block 502, once the system determines that the noise target weights should be updated, the system determines if the current frame is a source frame, at block 504. That is, the system determines if the frame is dominated by the desired source or voice and not noise or other interferer.

According to an embodiment, the spatial adaptation system now moves to block 506 if a source frame is detected, i.e., vad=1 or vad=2. At block 506, the system determines the update weights as discussed below. At block 508, the system modifies instantaneous magnitude ratios. According to an embodiment, the instantaneous magnitude is modified such that $$\mathrm{MR}_{mod,i}=\mathrm{MR}_i-\overline{\mathrm{MR}}_{V,i}^{fixed}$$

where $\overline{\mathrm{MR}}_{V,i}^{fixed}$ is a voice target.

At this point, the flow moves to block 510 in FIG. 4, where the noise targets are updated, according to an embodiment for the case that a voice frame is detected. As such, the noise target weights are determined using weights, $w_{S,i}$, determined as $$w_{S,i} = 1 - r1 + \frac{r1}{1 + \exp(a1(postSNR_i - a2))}$$

For an embodiment the weights control, in each frequency band, how much the current frame should contribute in the updating of the noise targets. According to an embodiment, where the spatial adaptation system updates the noise target based on a frame classified as containing the desired source (e.g. voice), the weights are computed so that frequency bands with high values of postSNR contribute to the updating. In the recursive averaging used for an embodiment for updating the noise targets, and discussed below, a weight equal to 1 means that no updating occurs in that frequency band. In addition, weights that are less than 1 (and non-negative) provide for magnitude ratios of the current frame to contribute to the noise target.

For an embodiment, r1, used to set the maximum rate of adaptation, is tuned so that the overall trade-off between convergence rate and stability of the noise target is at a desired level.

In addition, a2 is tuned so that low signal-to-noise ratio ("SNR") frequency bands are updated to a lesser extent, and tuned so that bands are updated to a greater extent where the desired source is strong. Moreover, a1 is used to tune the "abruptness" of the transition between "full update" and "no update." For an embodiment, setting a1 to a large value leads to the weight becoming either 1 or 1−r1 depending on if postSNR is less than a2 or larger than a2, respectively. Having a smooth transition between these two extremes increases the robustness of the adaptation, according to an embodiment; e.g., it lowers the risk of never updating because postSNR is more consistently less than a2. For some embodiments, r1, a1 and a2 are determined experimentally for the best operation of the system over a variety of conditions and stored in memory for runtime use. Moreover, for an embodiment r1, a1, and a2 are frequency dependent. For other embodiments, r1 is between the range from 0.05 to 0.1, a1 is 1, and a2 is set around 10 dB. According to an embodiment, the values of r1 are related to the sampling frequency and the stride of the input signal conversion module 106.

At block 510, when a source frame is detected, the magnitude ratio noise target is updated as follows:

$$\overline{\mathrm{MR}}_{N,i}(\tau)=w_{S,i}\overline{\mathrm{MR}}_{N,i}(\tau-1)+(1-w_{S,i})\mathrm{MR}_{mod,i}$$

where $w_{S,i}$ is determined as described above

Returning now to block 504 in FIG. 4, if a noise frame is detected, i.e. vad=0 or vad=2, the embodiment moves to block 512. At block 512, the spatial adaptation system determines the noise update weights. For an embodiment, the noise update weights are determined by $$w_{N,i}=\left(1-s1+\frac{s1}{1+\exp(|postSNR_i-b2|^2/b1)}\right)$$

Here, s1, similar to r1 discussed above with regard to desired source weights, a trade-off is made between a convergence rate and stability. For an embodiment, b2 is set to the expected postSNR for noise (0 dB in an embodiment), and b1 controls the range of postSNR values that will contribute to noise target updating. For an embodiment, s1, b1, and b2 are determined empirically over varying conditions with multiple users to provide an optimal operating range for the spatial adaptation system and stored in tables for runtime use. According to an embodiment, s1, b1, and b2 are frequency dependent. For an embodiment, s1 ranges from 0.05 to 0.1, b1 is 10, and b2 is set around 0. Moreover, s1, for an embodiment, are related to the sampling frequency and the stride of the input signal conversion module 106.

In the case a noise frame is detected, i.e. vad=0 or vad=2, at block 510 the magnitude ratio for the noise targets is determined according to $$\overline{\mathrm{MR}}_{N,i}(\tau)=w_{N,i}\overline{\mathrm{MR}}_{N,i}(\tau-1)+(1-w_{N,i})\mathrm{MR}_i$$

where τ is the frame and i is the frequency band. For other embodiments, other frequency dependent features like MR (distance from maximum MR), PD, and COH are used by the spatial adaptation system to provide more robust weighting.

For embodiments discussed above, the rear microphone signal 108 is modified for microphone matching by the spatial adaptation system. For these embodiments, the rear microphone signal in frequency bin n after microphone matching is determined according to $$R_n=\overline{\mathrm{MR}}_{N\cdot n}^{out}\cdot R_n'$$

where $R_n'$ is the microphone signal in frequency bin n before microphone matching.

In other embodiments, the front microphone signal may be modified to perform microphone matching according to $$F_n=F_n'/\overline{\mathrm{MR}}_{N\cdot n}^{out}.$$

According to another embodiment, the spatial adaptation system may be based on estimation of ratios between rear and front signal energies, $\mathrm{MR}_{alternative}$=RB/FB, instead of ratios between front and rear.

For yet another embodiment, the spatial adaptation system may split the compensation between front and rear according to $$R_n=(\overline{\mathrm{MR}}_{N\cdot n}^{out})^{\alpha}\cdot R_n'$$

$$F_n=F_n'/(\overline{\mathrm{MR}}_{N\cdot n}^{out})^{1-\alpha}$$

where $0\leq\alpha\leq1$.

For an embodiment, the inference and the decision whether to update the noise target or not is done in frequency bands referred to below as decision bands. These decision bands need not be the same as the bands that the features are determined in. If, for example, the features are determined in 32 bands, one decision can be made for bands 1-4, one decision for bands 5-12, one decision for bands 13-25, and one decision for bands 26-32; thus in this example 4 different and possibly independent decisions are made. The number of decision bands is in this case 4. The number of decision bands is a parameter that is determined by experiments. The division into decision bands is also determined by experiments, according to an embodiment, thus, another example is to have 4 decision bands that groups the feature bands like 1-8, 9-17, 18-24, and 25-32.

For an embodiment, inference and noise target updating generalizes to inference and updating in separate decision bands. The aggregation of the band features into scalar features described in herein can be done in decision bands for an embodiment. The set I of feature bands that are included in the aggregation can be generalized to one set per decision band so that, for example, pd1 is determined as an aggregate with I={1-8}, pd2 is determined with I={9-17}, pd3 is determined with I={18-24}, and pd4 is determined with I={25-32}. The aggregates associated with mr and coh generalize similarly. Similarly, the frame power, pow, can be determined in decision bands. The aggregate of postSNR, psnr, can be generalized to decision bands by in each decision band summing the number of feature bands that have postSNR exceeding a certain threshold, and dividing that number by the number of feature bands in that decision band, according to an embodiment.

As described above for an embodiment, the GMMs are optimized offline on features that include any subset of, or all of the following features, mr, pd, coh, pow, delta features of mr, pd, coh, pow. The GMM based inference can be generalized to operate in decision bands by introducing one set of GMMs for each decision band, each set consisting of a GMM optimized on features from near-field speech (or optionally an acoustic mix of near-field speech and far-field noise), a GMM optimized on features from far-field noise only, and a GMM optimized on features from interferers. The procedure described herein for inferring either near-field speech, far-field noise, a combination of near-field speech and far-field noise, or interferer, is generalized to decision bands as is known in the art.

For an embodiment, if speech is inferred in a decision band the noise target in the feature bands associated with that decision band is updated using update weights wS and using the modified magnitude ratio as described herein.

For an embodiment, if noise is inferred in a decision band the noise target in the feature bands associated with that decision band is updated using update weights wN and using the unmodified magnitude ratio as described herein.

For an embodiment, if the inference in a decision band indicates both near-field speech and far-field noise, the noise target can be updated twice: once assuming speech is inferred, and once assuming noise is inferred; in this case the update weights provide for a soft decision in each feature band. Another option is to infer that the decisions are too unreliable and not update the noise target at all. Yet another alternative is to update assuming noise if the likelihood of the noise GMM is higher than the likelihood of the speech GMM, and vice versa if the likelihood of the speech GMM is higher.

In an embodiment, the method for detecting microphone self noise is implemented in each decision band. The generalization of full band aggregate features into a set of features in each decision band is as described herein. The thresholds in case of self noise detection in decision bands are tuned separately in each decision band, for an embodiment. The decision to update the noise target or not in a decision band based on if microphone self noise is detected in a decision band is done separately and possibly independently in each decision band according to an embodiment.

For an embodiment, a benefit of inference and noise target updating in bands, consider the case where the near-field desired source, and the far-field noise are separable in frequency, i.e., the desired source dominates in one set of bands say bands 1-16, and the noise dominates in another set of bands say bands 17-32. An embodiment includes using four decision bands that divide the feature bands into groups 1-8, 9-17, 18-24, and 25-32. For this embodiment, the noise targets in bands 1-8, and 9-17 can be updated using the procedure described for updating when the noise is detected, and the noise targets in bands 18-24, and 25-32 can be updated using the procedure described for updating when the near-field speech is detected.

The second decision band (9-17) in this example contains both speech (in feature bands 9-16) and noise (in band 17) and illustrates a decision bands may not exactly coincide with the input signal bands. For an embodiment, using more decision bands increases the frequency selectivity in the noise target estimation which lessens the negative impact of fixed decision band boundaries. For some embodiments, the use of more decision bands provides less information for each decision band to base the decision on, and ultimately the number of decision bands and the exact division is a trade-off between frequency selectivity and decision reliability.

In accordance with this disclosure, the components, process steps, and/or data structures described herein may be implemented using various types of hardware, operating systems, computing platforms, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used without departing from the scope and spirit of the inventive concepts disclosed herein. Where a method comprising a series of process steps is implemented by a computer, a machine, or one or more processors and those process steps can be stored as a series of instructions readable by the machine, they may be stored on a tangible medium such as a memory device (e.g., ROM (Read Only Memory), PROM (Programmable Read Only Memory), EEPROM (Electrically Erasable Programmable Read Only Memory), FLASH Memory, Jump Drive, and the like), magnetic storage medium (e.g., tape, magnetic disk drive, and the like), optical storage medium (e.g., CD-ROM, DVD-ROM, paper card, paper tape and the like) and other types of program memory.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The term "exemplary" is used exclusively herein to mean "serving as an example, instance or illustration." Any embodiment or arrangement described herein as "exemplary" is not necessarily to be construed as preferred or advantageous over other embodiments. While embodiments and applications have been shown and described, it would be apparent to those skilled in the art having the benefit of this disclosure that many more modifications than mentioned above are possible without departing from the concepts disclosed herein.

What is claimed is:

1. A spatial adaptation system comprising:

a frame power module configured to determine a determined frame power based on at least a converted front microphone signal;

a posterior signal to noise ratio module configured to determine a determined posterior signal to noise ratio that represents a signal to noise ratio of a noise source based on said converted front microphone signal, wherein the determined posterior signal to noise ratio is a temporal feature;

an inference and weight module configured to receive a plurality of inputs based on two or more input signals captured by at least two microphones, said plurality of inputs including the determined frame power and the determined posterior signal to noise ratio, said inference and weight module configured to determine one or more noise target weights based on at least said determined posterior signal to noise ratio;

a noise magnitude ratio update module coupled with said inference and weight module, said noise magnitude ratio update module configured to receive said one or more noise target weights from said inference and weight module and configured to determine an updated noise target value based on said one or more noise target weights from said inference and weight module, said updated noise target value used to adapt a power level of at least one of said two or more input signals captured by said at least two microphones; and a spatial feature module coupled with said inference and weight module, said spatial feature module to determine one or more spatial features based on said two or more input signals, wherein said inference and weight module determines one or more noise target weights based on said one or more spatial features determined by said spatial feature module.

2. The system of claim 1, wherein said one or more spatial features include magnitude ratio based on said two or more input signals, phase difference based on said two or more input signals, and coherence based on said two or more input signals.

3. The system of claim 1, wherein at least two of said plurality of inputs are represented as frequency-domain signals.

4. The system of claim 3, wherein said inference and weight module uses one or more Gaussian mixture models to classify said at least two of said plurality of inputs.

5. The system of claim 4, wherein said inference and weight module classifies said at least two of said plurality of inputs into one or more classes including clean signal, noise, and interferer.

6. The system of claim 3, wherein inference and weight module determines a maxima follower of magnitude ratios based on said at least two of said plurality of inputs.

7. The system of claim 6, wherein said inference and weight module discriminates between near-field source and far-field noise based on said maxima follower.

8. A system for spatial adaptation comprising:

a plurality of microphones to capture a sound source;

an input signal conversion module coupled with a first microphone of said plurality of microphones and a second microphone of said plurality of microphones, said input conversion module configured to convert said sound source captured by said first microphone into a first frequency-domain signal and said sound source captured by said second microphone into a second frequency-domain signal;

a spatial feature module coupled with input conversion module, said spatial feature module configured to determine one or more spatial features based on at least one of said first frequency-domain signal and said second frequency-domain signals;

an inference and weight module coupled with said spatial feature module, said interference and weight module configured to receive said one or more spatial features from said spatial feature module, said inference and weight module configured to determine one or more inferences about said sound source, said one or more inferences determined based on said one or more spatial features;

a spatial adaptation module coupled with said input signal conversion module, said spatial feature module, and said inference and weight module, said spatial adaptation module configured to determine a frame power based on said first frequency-domain signal and configured to determine a posterior signal to noise ratio that represents a signal to noise ratio of a noise source based on said first-frequency-domain signal, wherein the determined posterior signal to noise ratio is a temporal feature, said spatial adaptation module configured to determine a noise target value based on said one or more spatial features and said posterior signal to noise ratio; and a matching multiplier coupled with said input signal conversion module, said spatial feature module, and said spatial adaptation module, said matching multiplier configured to adjust a second power level of said second frequency-domain signal to generate a matched signal based on said noise target value.

9. The system of claim 8 further comprising a beamformer module coupled with said input signal conversion module, said spatial feature module, said beamformer to generate a combined signal based on said matched signal and at least one of said first frequency-domain signal and said second frequency-domain signal.

10. The system of claim 9 further comprising a combined signal multiplier and an inference and weight module coupled with said combined signal multiplier, said spatial feature module, and said spatial adaptation module, said spatial adaptation module to determine one or more spatial features, said inference and weight module to determine a gain based on one or more spatial features and said sound source, and said combined signal multiplier to generate an output signal based on said gain and said combined signal.

11. The system of claim 8, wherein said spatial adaptation module determines said noise target value only if said one or more inferences indicate said sound source is dominated by a desired source.

12. A method for spatial adaptation, the method comprising:

receiving a first frequency-domain signal based on an output signal from a front microphone and a second frequency-domain signal based on an output signal from a rear microphone;

determining one or more spatial features based on at least one of said first frequency-domain signal and said second frequency-domain signal;

determining a determined frame power based on at least the first frequency domain signal;

determining a posterior signal to noise ratio that represents a signal to noise ratio of a noise source based on said first frequency-domain signal, wherein the determined posterior signal to noise ratio is a temporal feature;

determining one or more noise target weights based on said one or more spatial features, said determined frame power, and said posterior signal to noise ratio; and updating a noise target value based on said one or more determined noise target weights.

13. The method of claim 12 further comprising determining an interferer based on said one or more spatial features.

14. The method of claim 13, wherein said one or more spatial features include a magnitude ratio based on said first frequency-domain signal and said second frequency-domain signal, phase difference based on said first frequency-domain signal and said second frequency-domain signal, and coherence based on said first frequency-domain signal and said second frequency-domain signal.

15. A memory device readable by a machine, embodying a program of instructions executable by the machine to perform a method for suppressing noise in one or more of at least first and second channels, the method comprising:

receiving a first signal based on an output signal from a front microphone and a second signal based on an output signal from a rear microphone;

determining a plurality of spatial features based on said at least one of said first signal and said second signal;

determining a determined frame power based on at least the first frequency domain signal;

determining a posterior signal to noise ratio that represents a signal to noise ratio of a noise source based on said first signal, wherein the determined posterior signal to noise ratio is a temporal feature;

determining one or more noise target weights based on said one or more spatial features, said determined frame power, and said posterior signal to noise ratio; and updating a noise target value based on said one or more determined noise target weights.

16. The method of claim 15 further comprising determining an interferer based on one or more of said plurality of spatial features.

17. The method of claim 15, wherein said spatial features include magnitude ratio of based on said first signal and said second signal, phase difference based on said first signal and said second signal, and coherence first signal and said second signal.

18. The system of claim 1, wherein the posterior signal to noise ratio module determines the determined posterior signal to noise ratio based only on the converted front microphone signal.

19. The system of claim 1, wherein the determined posterior signal to noise ratio is based on a difference between a feature in a current frame and the feature in a previous frame.

20. The system of claim 1, wherein the one or more noise target weights are computed according to an equation $$w_{S,i} = 1 - r1 + \frac{r1}{1 + \exp(a1(postSNR_i - a2))}$$

wherein $w_{S,i}$ corresponds to the one or more noise target weights, S corresponds to a set of frequency bins, i corresponds to a frequency band, $postSNR_i$ corresponds to the determined posterior signal to noise ratio, r1 is between 0.05 and 0.1, a1 is 1, and a2 is 10 dB.

21. The system of claim 20, wherein r1 is related to a sampling frequency and a stride of an input signal conversion module.

* * * * *